US005623956A

United States Patent [19]

Kirkland

[11] Patent Number: 5,623,956

[45] Date of Patent: Apr. 29, 1997

[54] DISHWASHER STRAINING SYSTEM

[75] Inventor: Dan Kirkland, Winterville, N.C.

[73] Assignee: White Consolidated Industries, Inc., Cleveland, Ohio

[21] Appl. No.: 525,413

[22] Filed: Sep. 8, 1995

[51] Int. Cl.[6] ..... A47L 15/42

[52] U.S. Cl. ..... 134/104.3; 134/104.4; 134/111; 210/167; 210/171; 210/498

[58] Field of Search ..... 134/104.3, 104.4, 134/111; 68/18 F; 210/164, 167, 171, 498

[56] References Cited

U.S. PATENT DOCUMENTS

| | | | |
|---|---|---|---|
| 2,359,936 | 10/1944 | Peterson | 210/498 X |
| 2,720,771 | 10/1955 | Lewis | 68/184 |
| 3,335,867 | 8/1967 | Perl | 210/167 |
| 3,491,780 | 1/1970 | Kaldenberg | 134/111 X |
| 4,347,861 | 9/1982 | Clearman et al. | 134/109 X |
| 4,485,645 | 12/1984 | Mulder et al. | 210/167 X |
| 4,998,548 | 3/1991 | Lagerstrand | 134/111 |
| 5,165,433 | 11/1992 | Meyers | 134/111 X |
| 5,345,957 | 9/1994 | Cooper et al. | 134/111 X |
| 5,450,868 | 9/1995 | Young, Jr. | 134/111 |

*Primary Examiner*—Philip R. Coe
*Attorney, Agent, or Firm*—Pearne, Gordon, McCoy & Granger

[57] ABSTRACT

A straining system for use in a washer having a pump and a sump with a hub projecting therefrom. The straining system has a first surface and a second surface. The first surface has an outer perimeter and an inner opening that permits the hub to extend therethrough. Projecting from the first surface of the straining system are resilient connectors that secure the straining system to the hub. The second surface has an inner boundary joined to the outer perimeter of the first surface. From the inner boundary, the second surface extends outward and terminates at an edge. The second surface contains a plurality of slots arranged in a non-radial manner. The slots permit fluid to pass through the straining system, but prevent some articles from passing through the straining system and making contact with the pump.

18 Claims, 2 Drawing Sheets

Fig.2
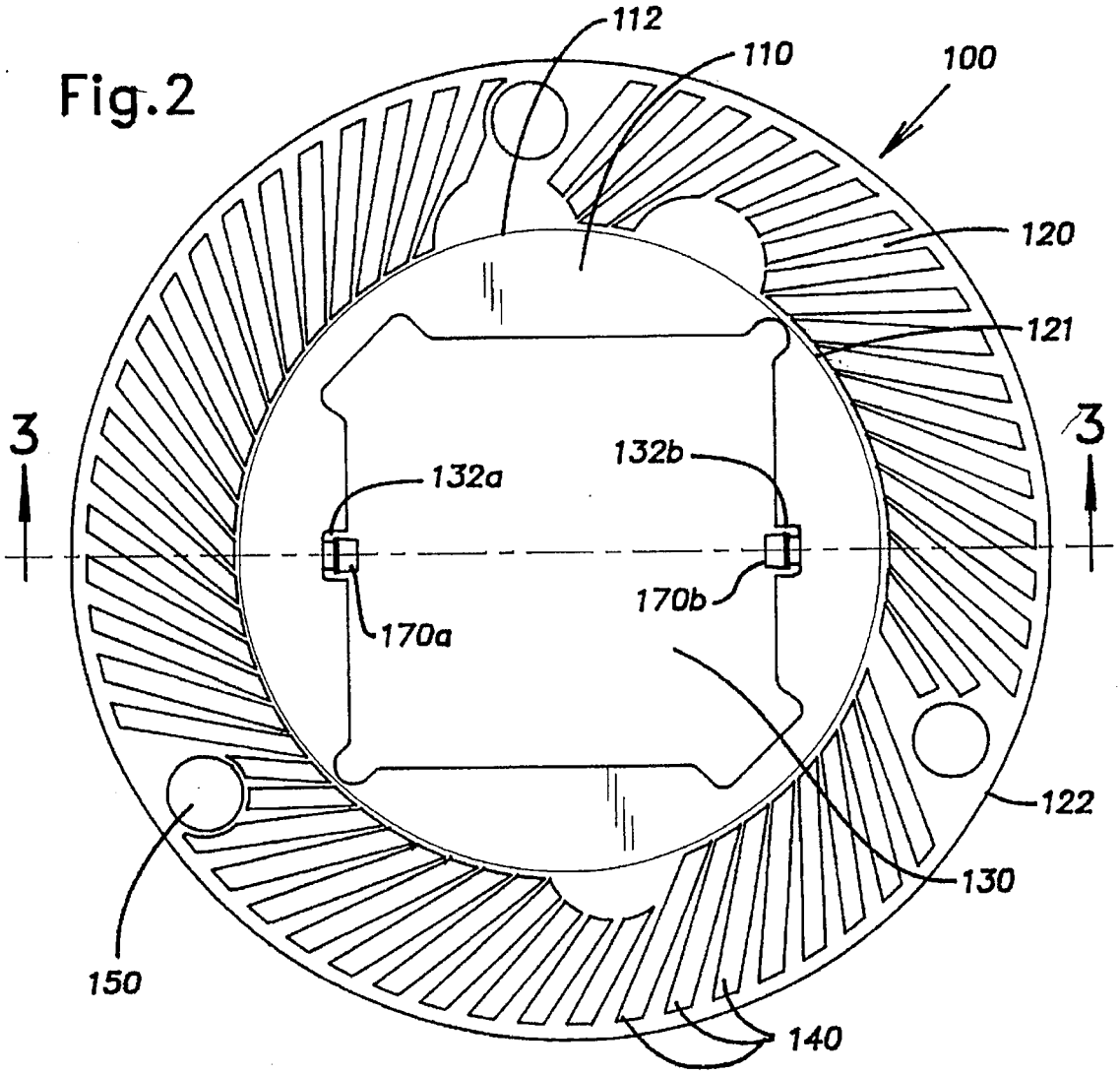
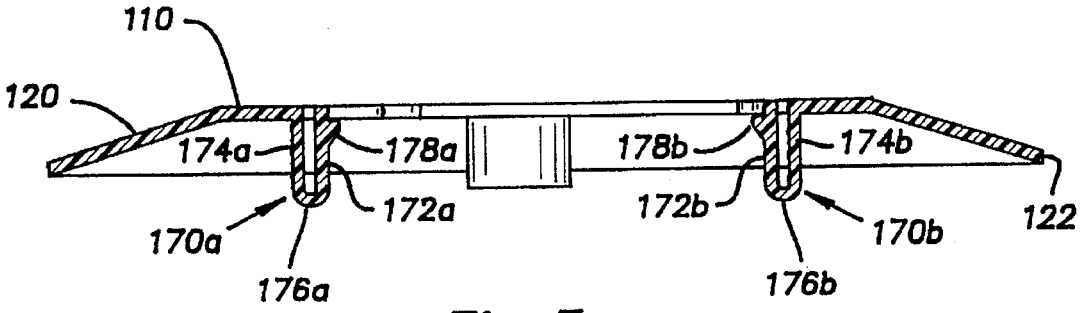
Fig.3

DISHWASHER STRAINING SYSTEM

BACKGROUND OF THE INVENTION

1. Field of the Invention

This invention relates to washers in general and, more particularly, to dishwashers having a straining system for preventing articles from coming in contact with the dishwasher pump.

2. Description of the Related Art

Washers commonly have a tub with a lower region defining a sump. Typically, a pump is mounted at the bottom of the sump and a hub with a spray arm projects upward from the center of the sump. The spray arm is rotatably mounted to the hub and distributes fluid throughout the tub. In such washers, the hub contains a conduit for conducting fluid up to the spray arm. The hub may also contain a portion of the pump such as an impeller. During washing and rinsing operations, the pump recirculates fluid from the sump up to the spray arm. As a result of the operation of the pump and natural forces, solid articles gravitate to the bottom of the sump where the pump inlet is located. If large articles such as knives, forks, pieces of glass, and straws come in contact with the pump, damage may occur to the pump.

It is known to equip washers with strainers to prevent large articles from coming into contact with the pump. Furthermore, it is known to have strainers disposed around a central hub inside the center of the washer. Such strainers shall hereinafter be referred to as annular strainers even though not all such strainers are circular. Known annular strainers extend out radially from the central hub with an upward inclination, with a downward inclination and with no inclination. Examples of such annular strainers include U.S. Pat. No. 4,347,861 to Clearman, U.S. Pat. No. 3,335,867 to Perl and U.S. Pat. No. 3,491,780 to Kaldenberg, all of which are incorporated herein by reference.

In the 867 patent to Perl and the 780 patent to Kaldenberg, the annular strainers are fastened to the central hub by tab and groove means. Other known annular strainers are fastened to the central hub by screws. Annular strainers fastened by screws are secure, but tend to be difficult to remove. Moreover, such strainers require detachable parts. Annular strainers fastened by tab and groove means are easy to remove, but tend to become loose. Accordingly, it would be advantageous to have an annular washer strainer that can be fastened securely without using detachable parts but is easily removable.

Known annular strainers contain openings that are large enough to permit an uninterrupted flow of fluid through the strainer, but are small enough to preclude the passage of large articles. Known annular strainers such as the annular strainer in the 867 patent to Perl contain a substantially uninterrupted pattern of openings. Other known annular strainers contain a plurality of slots that extend out radially. Annular strainers with radial slots permit fluid to flow freely through the strainer and adequately preclude the passage of bulky articles. Annular strainers with radial slots, however, tend to permit the passage of elongated articles such as straws and stirrers that have a small cross-sectional area in relation to their axial length. Accordingly, it would be advantageous to have an annular washer strainer with slots that are not arranged in a radial manner.

The present invention is directed to a straining system having the foregoing desired features.

SUMMARY OF THE INVENTION

It therefore would be desirable, and is an object of the present invention, to provide a washer straining system that can be fastened securely to the central hub without the use of detachable parts, but can be easily removed.

It would also be desirable, and is a further object of the present invention, to provide a washer straining system having slots that are arranged in a non-radial manner so as to better preclude the passage of elongated articles such as straws and stirrers.

The foregoing objects are achieved in the straining system of the present invention, which is to be used in a washer having a sump with a hub projecting therefrom. The straining system has a first surface and a second surface. The first surface has an outer perimeter and an inner opening that permits the hub to extend therethrough. Projecting from the first surface of the straining system are resilient connectors. The second surface has an inner boundary joined to the outer perimeter of the first surface. From the inner boundary, the second surface extends outward and terminates at an edge. The second surface contains a plurality of slots arranged in a non-radial manner.

More specifically, the invention comprehends a washer having a tub with a wash area, a straining system, a pump, a sump with an outer rim located at the bottom of the tub, a hub projecting upward from the sump and a spray arm rotatably mounted to the hub. The washer washes debris off of objects in the wash area using fluid that is pumped through the spray arm and into the wash area by the pump. Debris and fluid falling from the wash area is collected in the sump.

The straining system permits the fluid to pass through the straining system, but precludes a portion of the debris from passing through the straining system and making contact with the pump. The straining system has a first surface and a second surface. The first surface has an outer perimeter and an inner opening that permits the hub to extend therethrough. Projecting from the first surface of the straining system are resilient connectors for securing the straining system to the hub. The second surface has an inner boundary joined to the outer perimeter of the first surface. From the inner boundary, the second surface extends outward and terminates at an edge with a bottom that is contiguous with the outer rim of the sump. The second surface contains a plurality of slots arranged in a non-radial manner.

BRIEF DESCRIPTION OF THE DRAWINGS

The features, aspects, and advantages of the present invention will become better understood with regard to the following description, appended claims, and accompanying drawings where:

FIG. 2 shows a top view of the straining system; and

FIG. 3 shows a cross-sectional view of the straining system, taken on line 3—3 of FIG. 2.

DETAILED DESCRIPTION OF THE PREFERRED EMBODIMENTS

Figure 1:
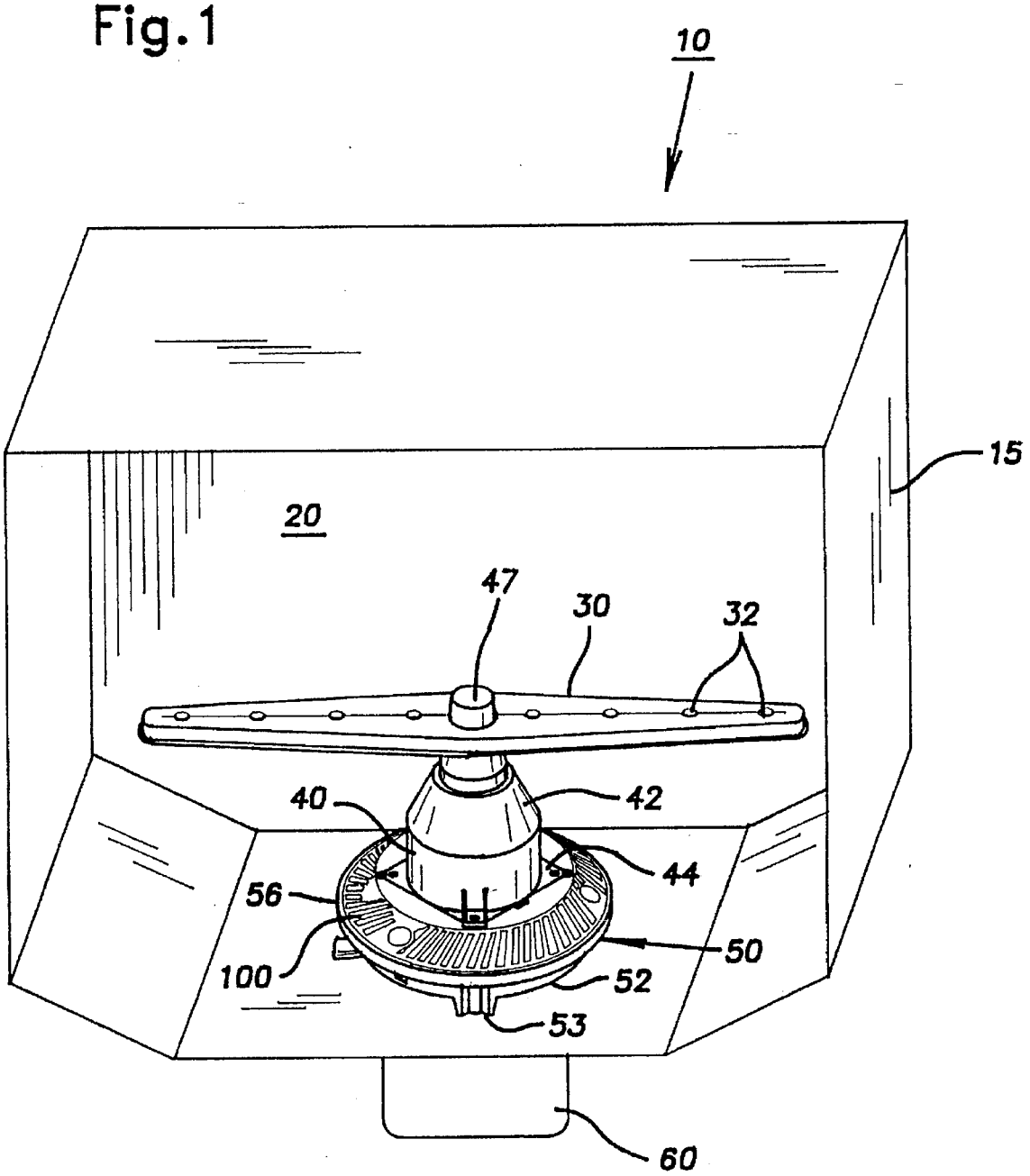
FIG. 1 shows a portion of a washer having a straining system embodied in accordance with the present invention.

Referring now to FIG. 1, there is shown a portion of a washer 10, such as a dishwasher, having a straining system embodied in accordance with the present invention. The washer 10 generally includes a tub 15, a wash area 20, a spray arm 30, a hub 40, a housing 50, a straining system 100 and a pump having a motor 60 and an upper impeller (not shown) and a lower impeller (not shown). The hub 40 is comprised of a support conduit 42 and a spacer base 44 secured to the housing 50. The spacer base 44 separates the upper and lower impellers and has a central opening (not shown). The spacer base 44 is constructed to permit fluid to flow through its sides and exit through the top and bottom of the central opening so as to make contact with the upper and lower impellers. Disposed around the spacer base 44 is the straining system 100.

The housing 50 has a base 52 with legs 53, an annular top surface (not shown) and a flange 56 projecting upward along the outer boundary of the top surface. The top surface is located above, but is integral with, the base 52. The top surface and base 52 define a sump wherein the lower impeller is located; the portion of the top surface abutting the flange 56 defining the outer rim of the sump. Three screws passing through the top surface secure the housing 50 to the bottom of the tub 15. The pump motor 60 is secured to the legs 53 of the base 52 by bolts that pass through the bottom of the tub 15. The pump motor 60 rotates the upper and lower impellers, causing fluid to flow through the spacer base 44.

The support conduit 42 is bolted to the spacer base 44 and covers the upper impeller and central opening of the spacer base 44. The support conduit 42 is substantially hollow and has a top opening (not shown) with a threaded shaft projecting therefrom. The support conduit 42 provides a passageway for fluid to travel up to the spray arm 30 which is rotatably fastened to the threaded shaft by a nylon nut 47. The spray arm 30, which is also substantially hollow, has a central opening (not shown) that overlays the top opening in the support conduit 42. Fluid from the support conduit 42 projects through the central opening in the spray arm 30 and exits through a series of jets 32 disposed along the length of the spray arm 30.

Referring now to FIG. 2, there is shown a top view of the straining system 100. The straining system 100 has a first surface 110 and a second surface 120. The first surface 110 is annular and has an outer perimeter 112. Centrally located within the first surface 110 is an opening 130 through which the upper surface of the spacer base 44 extends so as to be flush with the first surface 110, the outline of the opening 130 being substantially contiguous with the outline of the upper surface of the spacer base 44. The opening 130 is substantially square with enlarged corners. Two of the corners are arcuate and two are substantially rectangular, the pair of arcuate corners and pair of rectangular corners being diagonally aligned. The opening 130 also has two rectangular recesses 132*a* and 132*b* on two of its opposing sides. Two resilient fasteners 170*a* and 170*b* are joined to the outer edges of the two recesses 132*a* and 132*b*. It should be appreciated that in other embodiments of the present invention, the opening 130 may have a different shape in order to be contiguous with a spacer base or other component of the hub having a different configuration.

The second surface 120 has an inner boundary 121 that is joined to the outer perimeter 112 of the first surface 110. In the preferred embodiment of the invention, the second surface 120 and the first surface 110 are integral to each other because the straining system 100 is a single piece of molded plastic. It should be appreciated that the two surfaces 110, 120 can be separate pieces secured together by screws, latches or other fastening devices.

The second surface 120 extends outwardly and downwardly from its inner boundary 121 and terminates at an edge 122 that is flush with the inside of the flange 56 on the top surface of the housing 50. It should be appreciated that the present invention is not limited to a downwardly sloping second surface 120. In other embodiments of the present invention, the configuration of the hub 40 and/or housing 50 may require the second surface 120 to be upwardly sloping or coplanar with the first surface 110.

The second surface 120 contains a substantially continuous pattern of slots 140 that begin at the inner boundary 121 and extend to the edge 122. The slots 140 are substantially parallelograms and are evenly spaced along the inner boundary 121. The slots 140 project out at an angle relative to radii extending out in the plane of the second surface 120 from the center of the first surface 110, the angle being less than ninety (90) degrees. The pattern of slots 140 is interrupted in several areas by solid patches and by three evenly spaced circular openings 150. The areas where the pattern of slots 140 are interrupted contain openings that are preferably trapezoids and do not fully extend between the inner boundary 121 and the edge 122. When the straining system 100 is properly secured to the spacer base 44, the circular openings 150 are aligned above the heads of the three screws that secure the housing 50 to the bottom of the tub 15. The circular openings 150 provide access to the screws. The straining system 100 is secured to the spacer base 44 by the resilient fasteners 170*a* and 170*b*, which are shown in more detail in FIG. 3.

Referring now to FIG. 3, there is shown a cross-sectional view of the straining system, taken on line 3—3 of FIG. 2. The resilient fasteners 170*a* and 170*b* are U-shaped and are comprised of inner legs 172*a* and 172*b* and outer legs 174*a* and 174*b* joined at closed ends 176*a* and 176*b* that project downward towards the housing 50. The upper ends of the outer legs 174*a* and 174*b* are joined to the first surface 110 at the outer edges of the recesses 132*a* and 132*b* in the opening 130. The upper ends of the inner legs 172*a* and 172*b* are unattached and have lips 178*a* and 178*b*. When the straining system 100 is secured to the spacer base 44, the lips 178*a* and 178*b* are wedged under the upper surface of the spacer base 44, thereby precluding vertical movement of the straining system 100. In order to move the straining system 100 vertically, the inner legs 172*a* and 172*b* must be pushed towards the outer legs 174*a* and 174*b* so as to laterally move the lips 178*a* and 178*b* away from the underside of the upper surface of the spacer base 44.

Referring back to FIG. 1, the straining system 100 is installed by removing the nylon nut 47 and detaching the spray arm 30 from the support conduit 42. The opening 130 in the straining system 100 is aligned over the hub 40 such that the circular openings 150 are above the three screws in the top surface (not shown) of the housing 50. The straining system 100 is then moved downward until the resilient fasteners 170*a* and 170*b* snap onto the spacer base 44. As the sloped fronts of the lips 178*a* and 178*b* make contact with the upper surface of the spacer base 44, the inner legs 172*a* and 172*b* are compressed with the outer legs 174*a* and 174*b*, causing the lips 178*a* and 178*b* to move away from, and pass below, the upper surface of the spacer base 44. When the lips 178*a* and 178*b* are below the upper surface of the spacer base 44, they spring outward and become wedged under the upper surface, thereby securing the straining system 100 to the spacer base 44.

During the washing operation, the pump motor 60 rotates the impellers in a manner that forces fluid, such as wash water, up through the support conduit 42 and into the spray arm 30. Sprays of fluid issue from the jets 32 in the spray arm 30, causing the spray arm 30 to rotate. The sprays of fluid impinge upon the objects being washed, such as dishes and utensils, that are supported in the wash area 20 by baskets (not shown). As a result, small particles, such as food, and larger articles, such as straws and stirrers, are removed from the objects being washed. In addition, objects, such as knives and forks, may become dislodged and fall from the wash area 20. The small particles, larger articles and loose objects are hereinafter referred to as "debris". As the fluid and debris gravitate to the bottom of the sump, contact is made with the straining system 100. The fluid flows through the straining system 100 via the slots 140 and through the sides of the spacer base 44, exiting into the upper and lower impellers. The larger pieces of debris, however, are blocked by the straining system 100 and are prevented from entering the passages and damaging the impellers.

Although the preferred embodiments of this invention have been shown and described, it should be understood that various modifications and rearrangements of the parts may be resorted to without departing from the scope of the invention as disclosed and claimed herein.

What is claimed is:

1. A straining system for use with a washer having a sump with a hub projecting therefrom, the straining system comprising:

a first surface for horizontal placement above the sump, the first surface having resilient connectors projecting therefrom and including an outer perimeter and an inner opening, the inner opening permitting the hub to extend through the first surface; and a second surface having an inner boundary joined to the outer perimeter of the first surface, the second surface extending outwardly from the inner boundary and terminating at an edge, the second surface having a plurality of slots formed therein.

2. The straining system of claim 1 wherein the second surface has circular access openings.

3. The straining system of claim 1 wherein the second surface has a downward inclination in relation to the first surface.

4. The straining system of claim 3 wherein the first surface is annular and the edge of the second surface is circular.

5. The straining system of claim 4 wherein the slots are at angles to radii projecting from the center of the first surface in the plane of the second surface, the angles being less than ninety degrees.

6. The straining system of claim 5 wherein a majority of the slots are substantially parallelograms.

7. The straining system of claim 6 wherein a majority of the slots extend between the inner boundary of the second surface and the edge of the second surface.

8. A washer for washing debris off of objects using fluid, said washer comprising:

a tub having a wash area for washing the objects;

a sump for collecting the fluid and the debris falling from the wash area, said sump being located at the bottom of the tub and having an outer rim;

a hub projecting from the sump;

a spray arm rotatably mounted to the hub, said spray arm having jets for projecting sprays of fluid into the wash area;

a pump for pumping the fluid from the sump up to the spray arm and thence into the wash area; and a straining system comprising:

a first surface horizontally located above the sump, the first surface having resilient connectors projecting therefrom and including an outer perimeter and an inner opening to permit the hub to extend therethrough, the resilient connectors releasably securing the straining system to the hub; and a second surface having an inner boundary joined to the outer perimeter of the first surface, the second surface extending outwardly from the inner boundary and terminating at an edge with a bottom that is contiguous with the outer rim of the sump, the second surface having a plurality of slots formed therein, the slots permitting the fluid to pass through the straining system and enter the sump, and the slots precluding a portion of the debris from passing through the straining system and entering the sump.

9. The washer of claim 8 wherein the second surface has a downward inclination in relation to the first surface.

10. The straining system of claim 9 wherein the sump is secured to the tub by vertically mounted screws.

11. The straining system of claim 10 wherein the second surface has circular openings aligned above the heads of the vertically mounted screws, thereby providing access to the screws.

12. The straining system of claim 11 wherein the first surface is annular and the edge of the second surface is circular.

13. The straining system of claim 12 wherein the slots are at angles to radii projecting from the center of the first surface in the plane of the second surface, the angles being less than ninety degrees.

14. The straining system of claim 13 wherein a majority of the slots are substantially parallelograms.

15. The straining system of claim 14 wherein a majority of the slots extend between the inner boundary of the second surface and the edge of the second surface.

16. The straining system of claim 1 wherein each of the resilient connectors is substantially U-shaped and has inner and outer legs, the outer legs being joined to the first surface, and the inner legs being disposed adjacent to the opening and each having an unattached end with a lip, the lips being adapted for engagement with the hub.

17. The washer of claim 8 wherein the hub comprises a base having a top portion; and wherein each of the resilient connectors of the straining system is substantially U-shaped and has inner and outer legs, the outer legs being joined to the first surface, and the inner legs being disposed adjacent to the opening and each having an unattached end with a lip, the lips being wedged under the top portion of the base so as to releasably secure the straining system to the hub.

18. The washer of claim 17 wherein the inner legs are resiliently movable toward the outer legs so as to enable the lips to be removed from underneath the top portion of the base, thereby enabling the strainer system to be removed from the hub.

* * * * *